United States Patent [19]

Masterson

[11] Patent Number: 4,569,516

[45] Date of Patent: Feb. 11, 1986

[54] ADJUSTABLE LEG FOR STILTS AND THE LIKE

[75] Inventor: Jon A. Masterson, Long Beach, Calif.

[73] Assignee: Wallboard Tool Company, Inc., Long Beach, Calif.

[21] Appl. No.: 522,508

[22] Filed: Aug. 12, 1983

[51] Int. Cl.[4] ..... A63B 25/00

[52] U.S. Cl. ..... 272/70.1; 272/DIG. 4

[58] Field of Search ..... 272/70.1, 70.2, 70, 272/DIG. 4; 273/80 D; 3/4; 403/108, 109, 328, 329; 135/75, 107, 108

[56] References Cited

U.S. PATENT DOCUMENTS

| | | | |
|---|---|---|---|
| 2,427,841 | 9/1947 | Dichter | 403/329 X |
| 2,957,187 | 10/1960 | Raia | 273/80 D X |
| 3,346,882 | 10/1967 | Wilhoyte | 3/4 |

*Primary Examiner*—Richard J. Apley
*Assistant Examiner*—Kathleen D'Arrigo
*Attorney, Agent, or Firm*—Fulwider, Patton, Rieber, Lee & Utecht

[57] ABSTRACT

A vertically adjustable leg for stilts of the type utilized by construction workers as, for example, installers of wallboard. The adjustable leg includes upper and lower complementarily vertically slideably interfitted struts. A quick-action lock is interposed between the struts so as to permit the length of the assembled struts to be readily varied and thereby adjust the height of the stilt.

1 Claim, 5 Drawing Figures

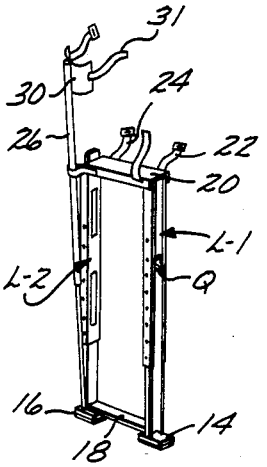
FIG. 1
FIG. 2
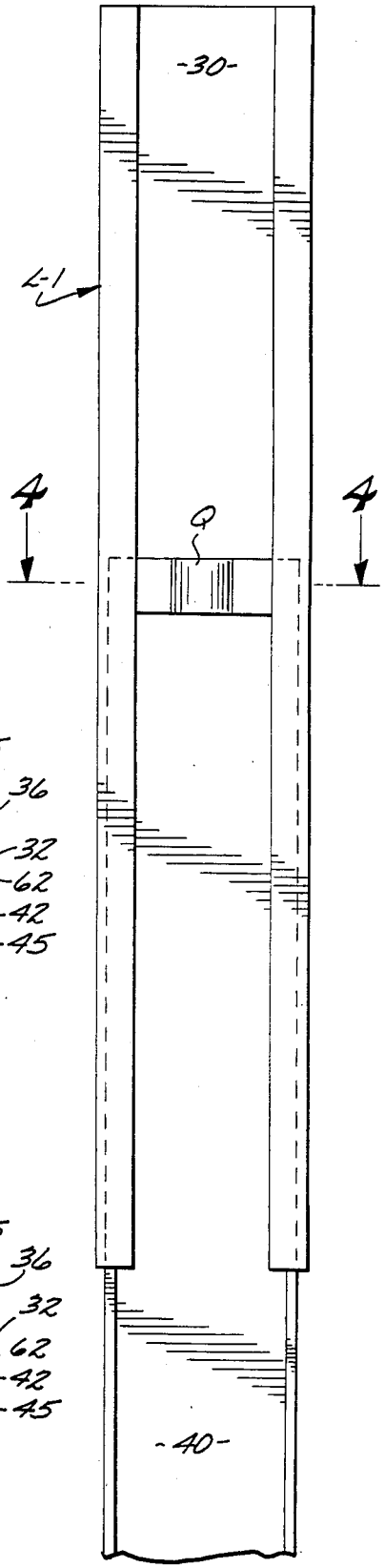
FIG. 3
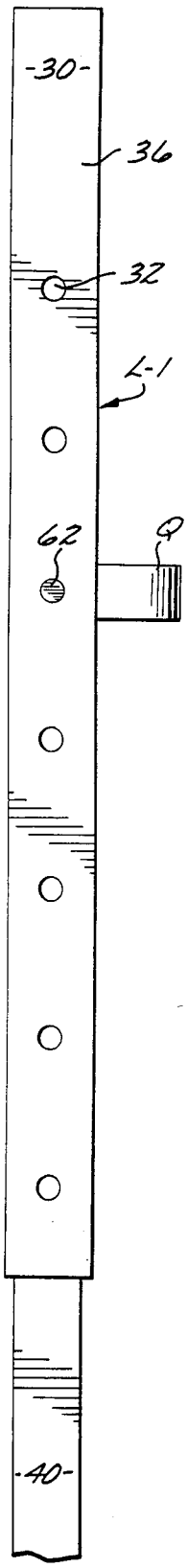
FIG. 4
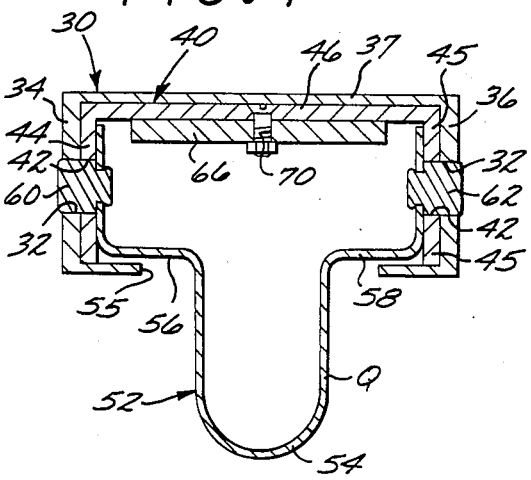
FIG. 5
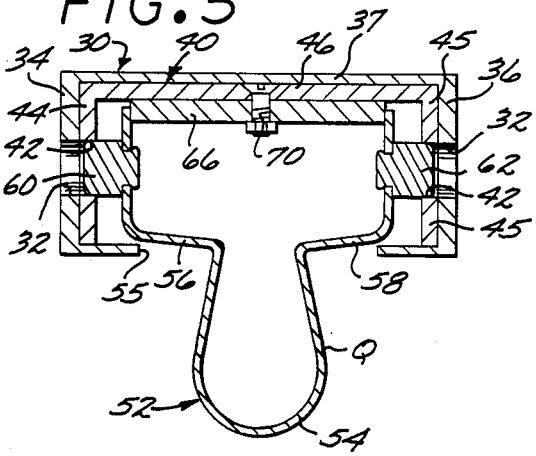

ADJUSTABLE LEG FOR STILTS AND THE LIKE

BACKGROUND OF THE INVENTION

Adjustable stilts that are strapped onto a workman's shoes to provide him with the necessary elevation to perform various tasks above the floor level have been in use several years. By way of example, the stilts are utilized during the installation of wallboards. The stilts include a pair of rigidly connected vertically adjustable legs defined by upper and lower channel-shaped struts. The bottom of each lower strut is attached to a rubber footpad. The upper ends of the upper struts are strapped to a workman's foot and leg. With heretofore proposed arrangements, a quick-action lock is provided between the upper and lower struts to control the effective height of such struts. The lock includes a plurality of vertically spaced, horizontally aligned holes formed in the struts. These holes selectively receive a pair of stop pegs. The stop pegs are slideably supported within a tube. The tube carries a pair of actuators which extend through slots in the tube to the stop pegs. A compression spring is interposed between the pegs within the tube to constantly bias the pegs outwardly. Each actuator is provided with a finger grip, with the grips being manually urged together to retract the pegs from within the adjustment holes to permit relative vertical sliding movement of the struts to thereby adjust the height of the stilt. Such locking arrangements have proven to be far from satisfactory. The parts of the lock tend to bind, particularly because of their exposure to foreign material, such as dust, present at construction jobs. Because of such tendency to bind, the stop pegs do not always securely lodge themselves within the adjustment holes. This leads to the danger that the lock will suddenly become inoperative causing the workman to risk a dangerous fall. The aforementioned binding tendency also requires considerable squeezing force to retract the stop pegs from within the adjustment holes.

SUMMARY OF THE INVENTION

It is a major object of the present invention to provide a locking arrangement for a vertically adjustable leg utilized with stilts and the like which eliminates the disadvantages of the heretofore proposed locking devices of this type.

Another object of the present invention is to provide a vertically adjustable leg of the aforedescribed nature having a unique quick-action lock interposed between the upper and lower struts of such leg which does not tend to bind and is therefore safer and easier to use than existing locks.

A more particular object of the present invention is to provide a vertically adjustable leg of the aforedescribed nature which utilizes a lock employing a single integral curved spring that carries a pair of adjustment pegs and firmly maintains such pegs within the adjustment holes of the struts.

Yet another object of the present invention is to provide a vertically adjustable leg of the aforedescribed nature wherein the locking arrangement is more economical of construction than heretofore proposed locking arrangements and will provide a long and trouble-free service life.

Other objects and advantages of the present invention will become apparent from the following detailed description when taken in conjunction with the appended drawings.

BRIEF DESCRIPTION OF THE DRAWINGS

FIG. 1 is a reduced perspective view showing a stilt utilizing a pair of vertically adjustable legs embodying the present invention;

FIG. 2 is a broken front view of a vertically adjustable leg embodying the present invention;

FIG. 3 is a broken side view of the vertically adjustable leg of FIG. 2;

FIG. 4 is a horizontal sectional view taken in enlarged scale along line 4—4 of FIG. 2 showing the quick-release lock thereof in a locked position; and FIG. 5 is a horizontal sectional view similar to FIG. 4, but showing said lock in an unlocked position.

DESCRIPTION OF A PREFERRED EMBODIMENT

Referring to the drawings and particularly FIG. 1 thereof, there is shown a stilt provided with a pair of vertically adjustable legs embodying the present invention. The stilt includes a front leg L-1 and a rear leg L-2 that are relatively vertically adjustable to control the height of the stilt. The legs are of generally similar construction and are mirror images of one another. The lower portion of each leg is provided with rubber footpads 14 and 16, respectively. The lower ends of such legs are rigidly connected by a cross-piece 18. The upper ends of legs L-1 and L-2 are rigidly connected by a foot support 20. Foot support 20 is provided with a toe strap 22 and a heel strap 24. A generally vertically extending leg bar 26 is rigidly secured to the rear leg L-2 and extends upwardly above foot support 20 to be engagable with a workman's leg (not shown) by means of a leg pad 30 and a leg strap 31. A quick-action lock Q is interposed between the upper and lower leg portions in a manner described in detail herebelow. Solely the lock Q of the front leg L-1 is visible in FIG. 1. It should be understood that the aforementioned legs L-1 and L-2, cross-piece 18, foot support 20, toe strap 22, heel strap 24, leg bar 24, leg pad 30, and leg strap 31 are of conventional construction.

More particularly and referring additionally to FIGS. 2 through 5, front leg L-1 includes an upper channel-shaped strut, generally designated 30, which is open at its top and bottom extremities. A plurality of vertically spaced, horizontally aligned adjustment holes 32 are formed in the side walls 34 and 36 of upper strut 30. The side walls are integral with back wall 37. A lower channel-shaped strut, generally designated 40, is vertically slideably disposed within upper strut 30. A pair of horizontally aligned peg holes 42 are formed in the upper portion of side walls 44 and 45 of lower strut 40. Side walls 44 and 45 are integral with back wall 46. The upper and lower ends of lower strut 40 are open. The dimensions of the upper and lower struts are so chosen that the struts can readily undergo relative vertical sliding movement with a minimum amount of wobbling.

Quick-action lock Q is interposed between the upper and lower struts 30 and 40 to selectively lock the lower strut to the upper strut at different vertical elevations and thereby adjust the effective vertical height of the leg. Lock Q includes a generally wishbone-configured horizontal squeeze spring, generally designated 52, having a generally U-shaped mid-portion 54 which extends through the front-facing opening 55 of the strut 30 to be engaged between the thumb and fore-finger of a user of the device. The legs of the U-shaped mid-portion integrally merge into a pair of generally L-shaped fingers 56 and 58 which are mirror images of one another and are spaced within the confines of the lower strut 40. The free ends of fingers 56 and 58 are rigidly connected to a pair of stop pegs 60 and 62 which are slideably disposed within peg holes 42 of lower strut 40. In this manner, quick-action spring 52 is supported at the upper portion of lower strut 40. Stop pegs 60 and 62 are selectively engagable with opposing, aligned adjustment holes 32 of upper strut 30. It should be understood that the squeeze spring 52 normally biases the stop pegs outwardly towards and into the adjustment holes 32, as indicated in FIG. 4.

Referring now to FIG. 5, the stop pegs 60 and 62 are retracted from within the adjustment holes 32 by applying a squeezing pressure to the mid-portion 54 of the quick-action spring 52. Inward movement of the spring fingers 56 and 58 is restricted by a horizontal stop plate 66 that is affixed to the upper portion of the lower strut 40 by a bolt and nut connection 70. In this manner, the stop pegs 60 and 62 are restrained from moving inwardly out of the confines of the peg holes 42 formed in the lower strut.

It should be understood that the construction of the rear leg L-2 is similar to the construction of the frong leg L-1 described hereinabove.

To adjust the effective length of the L-1 the lower strut 40 will be moved vertically within the upper strut 30 to a desired position approximately commensurate with the desired height of the stilt shown in FIG. 1. In order to effect movement of the lower strut relative to the upper strut, the squeeze spring 52 will be squeezed so as to retract the stop pegs 60 and 62 inwardly of the adjustment holes 32 as indicated in FIG. 5. When the stop pegs have been positioned at the desired location, squeezing pressure on the squeeze spring is released, and the pegs will automatically move outwardly into the selected adjustment holes 32 of the upper strut.

The aforedescribed arrangement provides a locking system which is fast and easy to operate, will not bind under normal conditions, and provides a firm interconnection of the upper and lower struts. It should be understood that the rear leg L-2 of the stilt of FIG. 1 will be adjusted as to its length in the same manner as described for the adjustment of the length of the front leg L-1. The design of the aforedescribed quick-action lock facilitates adjustment of the leg struts. This is an important consideration, particularly since the adjustment of the combined length of the two legs must take place simultaneously. It should be noted that there is a minimum tendency of the stop pegs 62 to bind in holes 32 and 42, but once these pegs are engaged with the adjustment holes, the pegs will firmly lock the upper and lower struts together.

It should also be understood that the aforedescribed leg arrangement may be utilized with workbenches, as well as with stilts. The retractability of the legs permits easy storage of the workbench such as within a car trunk. Additionally, the height of the workbench can be readily adjusted to conform to various working conditions.

Various modifications and changes may be made with respect to the foregoing detailed description without departing from the spirit of the present invention.

I claim:

1. A vertically adjustable leg for stilts and the like, said leg comprising:

an upper channel-shaped strut, the side walls of which are formed with a plurality of vertically spaced, horizontally aligned adjustment holes, and such side walls defining a front-facing opening;

a lower shaped channel-shaped strut vertically slideably disposed within said upper strut, the side walls of said lower strut being formed with a pair of horizontally aligned peg holes, and with such side walls terminating to either side of said front-facing opening;

a quick-action lock interposed between the upper and lower struts, such lock having a horizontally extending, generally wishbone-configured squeeze spring having a mid-portion that integrally merges into a pair of fingers which each carry an adjustment peg slideably disposed within the peg holes of the lower strut, such squeeze spring normally biasing said stop pegs outwardly for selective engagement with a desired pair of said adjustment holes to thereby adjust the combined length of said struts, said mid-portion rearwardly extending through said front-facing opening whereby said mid-portion is engageable by the thumb and forefinger of a user to effect manual squeezing of said spring effecting temporary retraction of said stop pegs from said adjustment holes; and a stop plate secured to said lower strut which is engaged by said fingers to limit inward movement of said pegs out of the confines of said peg holes.

* * * * *